US008857362B2

(12) United States Patent
Giles

(10) Patent No.: US 8,857,362 B2
(45) Date of Patent: Oct. 14, 2014

(54) MOBILE MARINE SERVICE MODULE

(76) Inventor: Jesse Michael Giles, Woodstock, GA (US)

( * ) Notice: Subject to any disclaimer, the term of this patent is extended or adjusted under 35 U.S.C. 154(b) by 153 days.

(21) Appl. No.: 13/567,002

(22) Filed: Aug. 3, 2012

(65) Prior Publication Data

US 2013/0032074 A1 Feb. 7, 2013

Related U.S. Application Data

(60) Provisional application No. 61/514,636, filed on Aug. 3, 2011.

(51) Int. Cl.
*B63B 35/40* (2006.01)
*B63B 9/00* (2006.01)

(52) U.S. Cl.
CPC ..... *B63B 9/00* (2013.01)
USPC ..... 114/259; 114/44

(58) Field of Classification Search
USPC ..... 114/44, 45, 47, 49, 259
IPC ..... B63C 1/02,1/06
See application file for complete search history.

(56) References Cited

U.S. PATENT DOCUMENTS

| | | | | |
|---|---|---|---|---|
| 2,386,650 | A * | 10/1945 | Bell | 114/259 |
| 4,341,174 | A * | 7/1982 | Stevens et al. | 114/45 |
| 7,410,395 | B2 * | 8/2008 | Kawai et al. | 440/6 |
| 2004/0237870 | A1 * | 12/2004 | Clarke et al. | 114/259 |
| 2007/0151499 | A1 * | 7/2007 | Maloney et al. | 114/259 |

* cited by examiner

*Primary Examiner* — Stephen Avila
(74) *Attorney, Agent, or Firm* — Lyman H. Smith

(57) ABSTRACT

A mobile marine service module and method allows for in-water service of marine vessels. The service module permits servicing and repair of a marine vessel without removal from the water. The service module can attach to a marine vessel, against the hull, below the water line. Once in place and sealed against the vessel's hull, water from inside the module can be removed to provide a platform to work on the vessel, such as to provide service to the vessel's outdrive, for example. With the mobile marine service module, the vessel remains afloat during service, with little or no stress on the hull.

10 Claims, 4 Drawing Sheets

MOBILE MARINE SERVICE MODULE

CROSS-REFERENCE TO RELATED APPLICATION

This application claims the benefit of priority of U.S. provisional application No. 61/514,636, filed Aug. 3, 2011, the contents of which are herein incorporated by reference.

BACKGROUND OF THE INVENTION

The present invention relates to marine service accessories and systems and more particularly, to a mobile marine module for in-water service of marine vessels.

Marine vessels can be difficult and costly to repair. Between the high cost of removal, the scheduling for pick-up and getting the repaired vessel back in the water can cause much angst on the owner. When removing the vessel from the water for repair, the vessel's hull can be stressed or damaged. Moreover, with the time involved in getting the vessel out and back in the water, along with the time to make the repairs, there is significant loss of use for the owner.

As can be seen, there is a need for a system for effecting repairs on a marine vessel without needing to remove the vessel from the water.

SUMMARY OF THE INVENTION

In one aspect of the present invention, a mobile marine service module, comprises a plurality of buoyancy control chambers operable to contain air and water to control the buoyancy of the mobile marine service module; first and second side hatches formed into a leading edge of the mobile marine service module; a middle hatch formed in the leading edge of the mobile marine service module, between the first and second side hatches; a hull seal disposed along the leading edge, the hull seal operable to seal against a hull of the vessel; and a control panel disposed in the mobile marine service module.

In another aspect of the present invention, a mobile marine service module comprises side floats disposed on each side of an enclosure, side tanks disposed on sides of the enclosure, and lower tanks disposed along a bottom of the enclosure, each of the side floats, side tanks and lower tanks operable to contain air and water to control the buoyancy of the mobile marine service module; first and second side hatches formed into a leading edge of the mobile marine service module; a middle hatch formed in the leading edge of the mobile marine service module, between the first and second side hatches; hatch hydraulic actuators operable to independent operate the first and second side hatches and the middle hatch; a hull seal disposed along the leading edge, the hull seal operable to seal against a hull of the vessel; a control panel disposed in the mobile marine service module; and one or more battery boxes providing power to the mobile marine service module.

In a further aspect of the present invention, a method for servicing a vessel while the vessel remains in water comprises moving mobile marine service module in place partially under the vessel; sealing a hull seal of the mobile marine service module along a hull of the vessel; adjusting the buoyancy of the mobile marine service module such that an enclosure provided by the mobile marine service module extends out of the water; removing water from the enclosure; and entering the enclosure to access a portion of the vessel while staying dry and while the vessel remains in the water.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides a mobile marine service module and method that allows for in-water service of marine vessels. The service module permits servicing and repair of a marine vessel without removal from the water. The service module can attach to a marine vessel, against the hull, below the water line. Once in place and sealed against the vessel's hull, water from inside the module can be removed to provide a platform to work on the vessel, such as to provide service to the vessel's outdrive, for example. With the mobile marine service module, the vessel remains afloat during service, with little or no stress on the hull.

Figure 1:
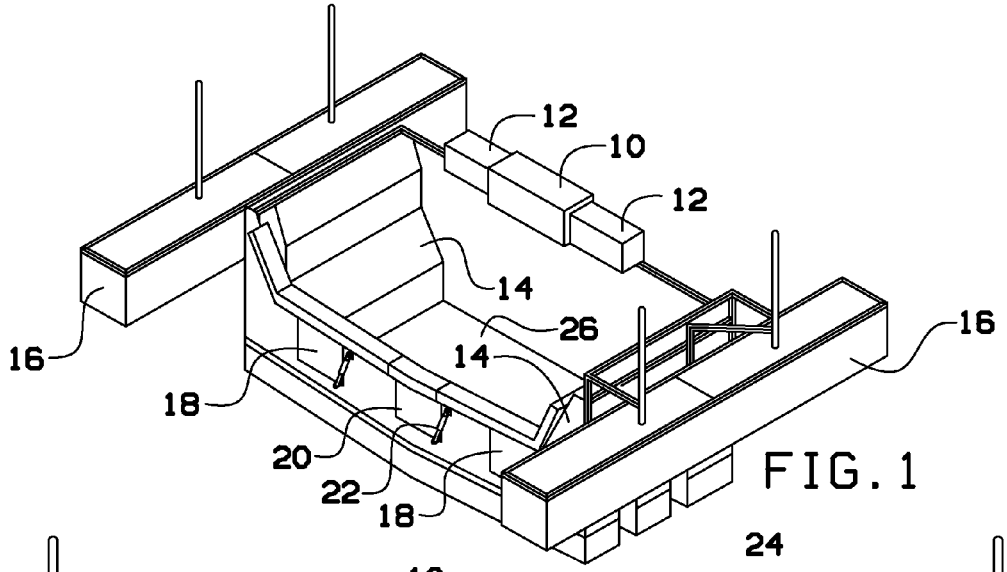
FIG. 1 is a perspective view of a mobile marine service module according to an exemplary embodiment of the present invention.
Figure 2:
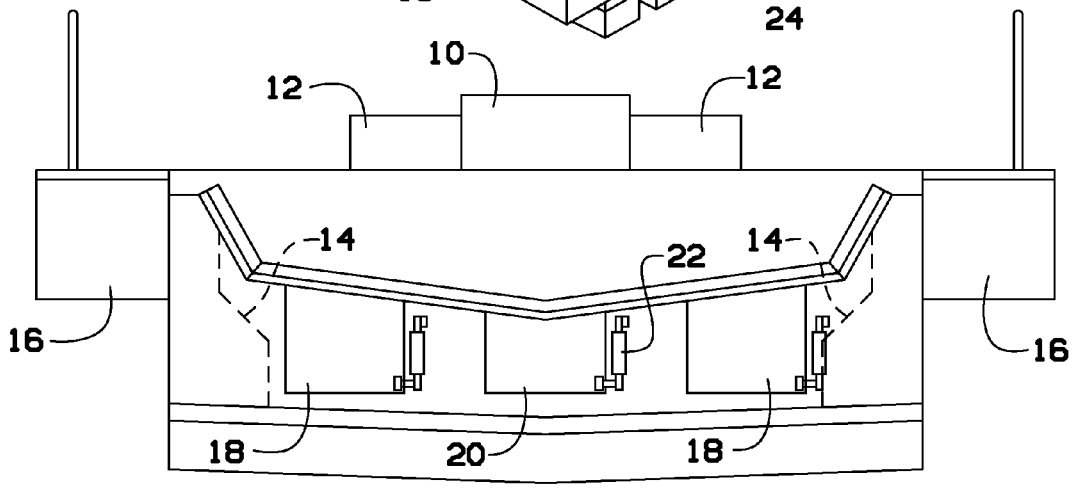
FIG. 2 is a front view of the mobile marine service module of FIG. 1.
Figure 3:
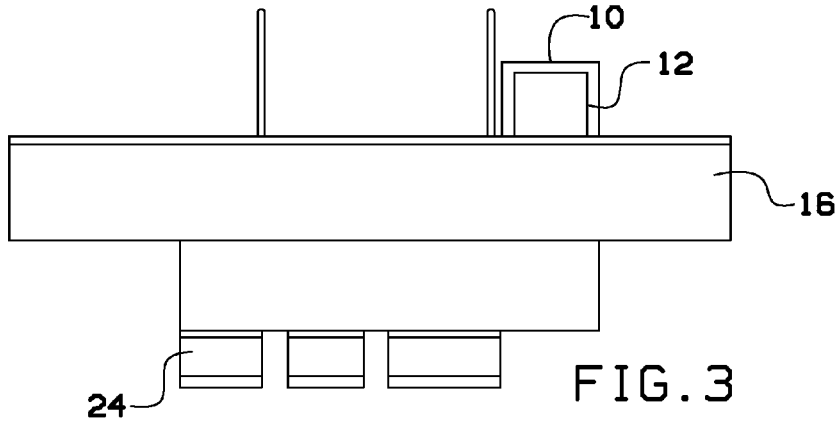
FIG. 3 is a side view of the mobile marine service module of FIG. 1.
Figure 4:
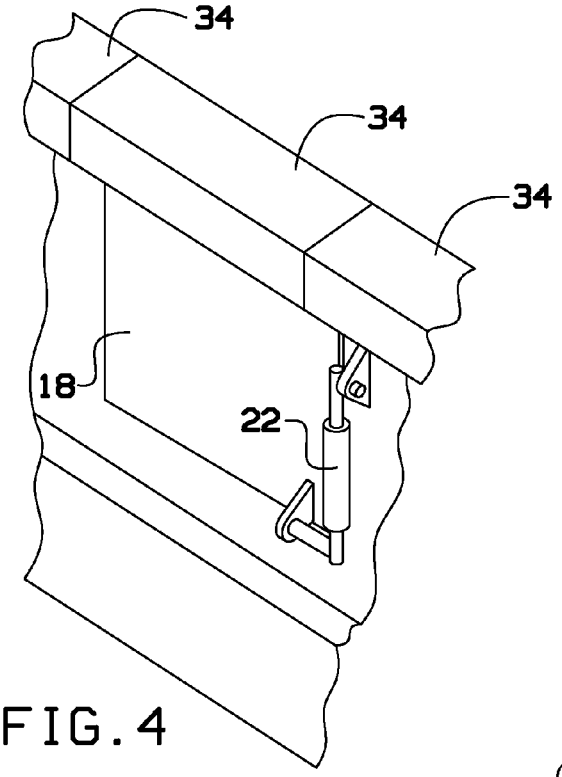
FIG. 4 is a detailed perspective view of a side hatch, in a closed configuration, of the mobile marine service module of FIG. 1.
Figure 5:
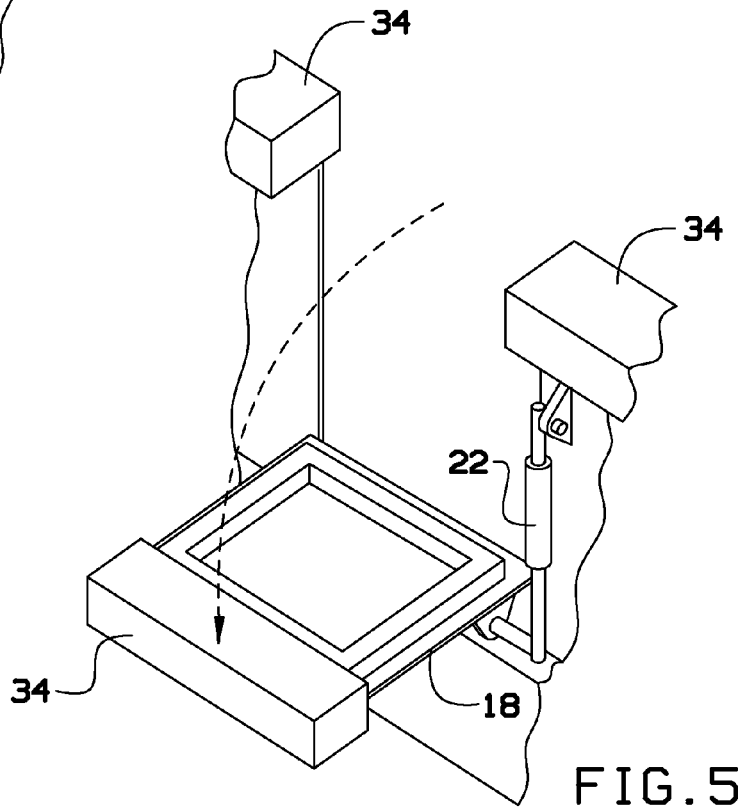
FIG. 5 is a detailed perspective view of a side hatch, in an open configuration, of the mobile marine service module of FIG. 1.

Referring to FIGS. 1 through 5, a mobile marine service module, as shown in FIG. 1, can include a control panel 10 powered by one or more battery boxes 12. In some embodiments, a shore line (not shown) can be provided to provide power to the mobile marine service module, saving life of the battery boxes 12. The control panel 10 can attach to a back wall of the service module. A plurality of hatches, such as first and second side hatches 18 and a middle hatch 20 can be provided on a forward wall of the service module. A hatch hydraulic actuator 22 can be used to control the opening and closing of the hatches 18, 20. The control panel 10 can be used to control the hatch hydraulic actuators 22.

A plurality of floats can be provided to control the buoyancy of the service module. The floats can include side floats 16 on each side of the service module. The side floats 16 can fill with air to provide lift to the service module and cause the service module to seal against a hull 36 of a vessel 28. A hull seal 34 can be disposed to help provide a suitable seal. The hull seal 34 can be made from various materials, such as a flexible foam rubber, for example.

To further help control buoyancy of the service module, side tanks 14 and lower tanks 24 can contain variable amounts of water and air. The control panel 10 can control the amount of air in the side floats 16 and the amount of water in the side tanks 14 and the lower tanks 24.

A working platform 26 in provided as a bottom for the service module. The working platform 26 provides a surface for a person performing service to work from, while keeping dry.

Figure 6:
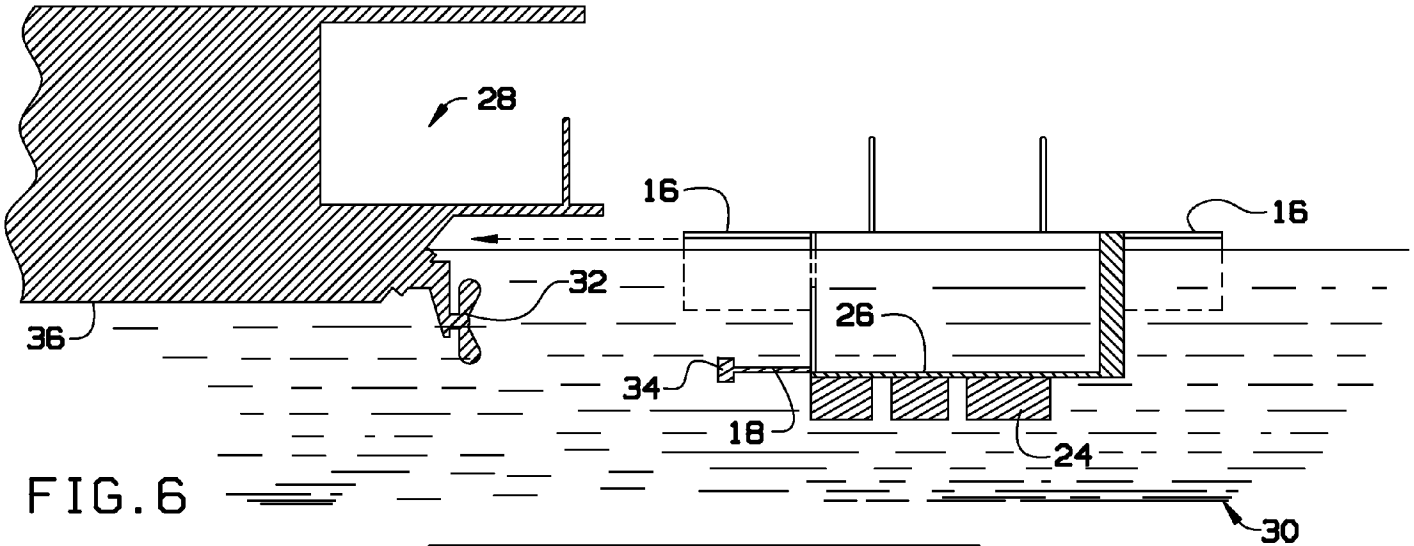
FIG. 6 is a cross-sectional view showing the mobile marine service module of FIG. 1 moving into position against a vessel.
Figure 7:
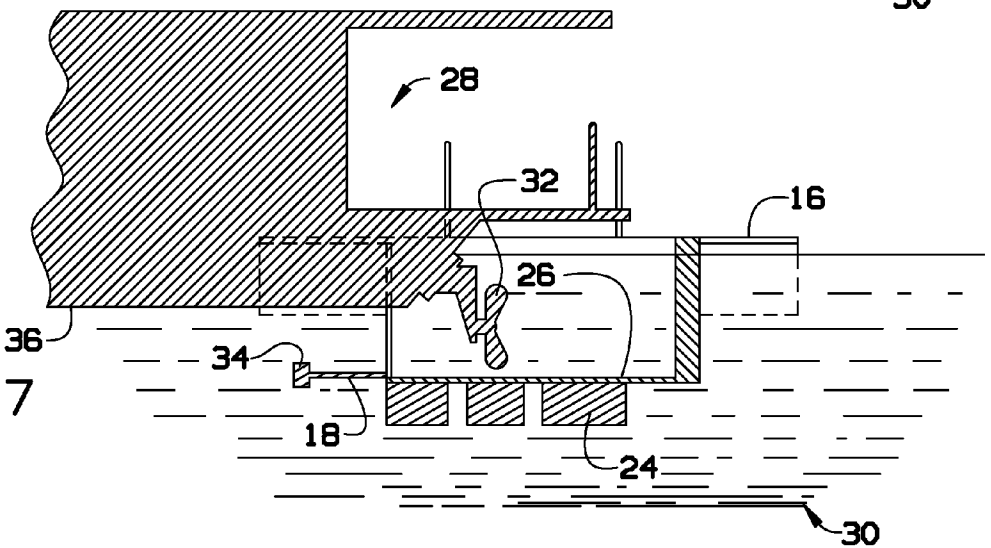
FIG. 7 is a cross-sectional view showing the mobile marine service module of FIG. 1 positioned against the vessel with a side hatch open.

Referring now to FIGS. 6 through 7, the service module can be brought to the vessel 28 that requires service. For example, the service module can be towed behind a boat.

Appropriate hatches can be opened as the service module approaches the vessel 28. For example, for a twin drive vessel, the side hatches 18 can both be opened. For a single screw vessel, the middle hatch 20 can be opened. These hatches 18, 20 allow the service module to be positioned without having to submerge the service module or raise an outdrive 32.

Figure 8:
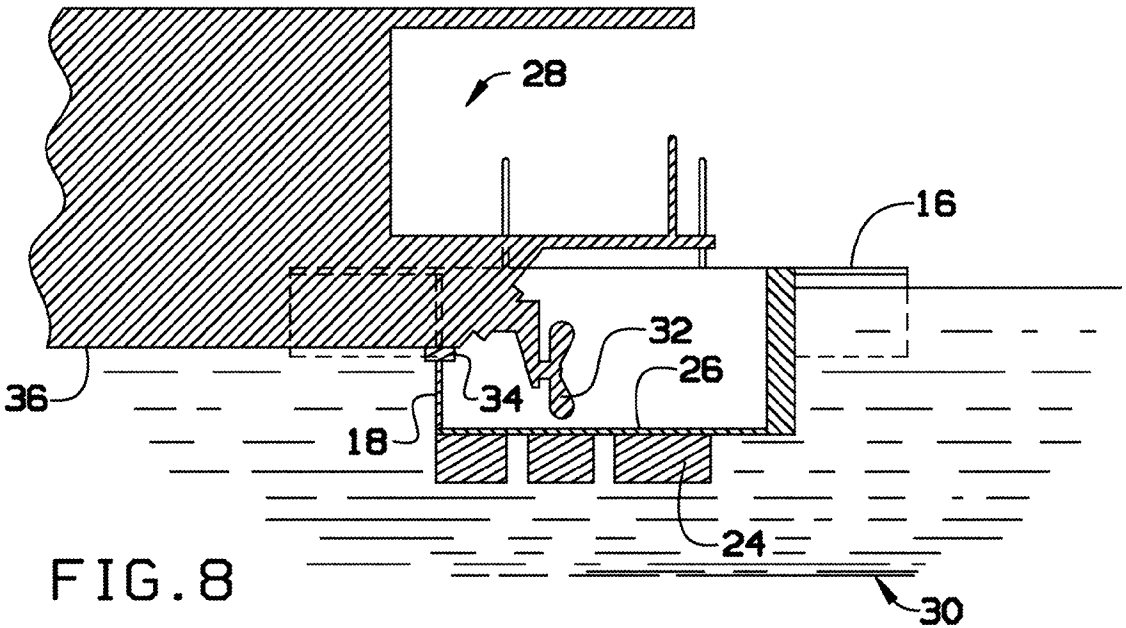
FIG. 8 is a cross-sectional view showing the mobile marine service module of FIG. 1 positioned against the vessel with the side hatch closed.

The service module is then placed in position, as shown in FIG. 7. The hatches 18 are then closed as shown in FIG. 8. At this time, air in the side float 16 can be added and water in the side tanks 14 and the lower tanks 24 can be adjusted to obtain the proper lift to cause the hull seal 34 to seal against the hull 36 of the vessel 28. The back wall and sides of the service water may be above the surface of the water 30, as shown in FIG. 7. Water inside the service module can be pumped out and appropriate lift can be provided in the service module so that a mechanic, tools and the like can be brought into the service module for working on the vessel 28.

The enclosure of the service module can be any size and depth. In some embodiments, the enclosure can be about 6-feet, 6-inches deep and about 15 feet wide, with a height of about 5 feet, for example.

Air can be supplied to the side floats 16 through various mechanisms. An air pump (not shown) can be controlled by the control module 10, for example, and powered by battery boxes 12. Water can be pumped out of the service module, once in place as shown in FIG. 8, by various mechanisms. For example, one or more bilge pumps can be powered by the battery boxes 12 to remove any water that enters the service module.

The service module can be made from various materials and methods, such as metal fabrication. The hull seal 34 can be made in various sizes, shapes and angles, depending on the hull size, shape, dead rise angles, and the like of the vessel 28.

It should be understood, of course, that the foregoing relates to exemplary embodiments of the invention and that modifications may be made without departing from the spirit and scope of the invention as set forth in the following claims.

What is claimed is:

1. A mobile marine service module, comprising:

a plurality of buoyancy control chambers operable to contain air and water to control the buoyancy of the mobile marine service module;

first and second side hatches formed into a leading edge of the mobile marine service module;

a middle hatch formed in the leading edge of the mobile marine service module, between the first and second side hatches;

a hull seal disposed along the leading edge, the hull seal operable to seal against a hull of a vessel; and a control panel disposed in the mobile marine service module.

2. The mobile marine service module of claim 1, further comprising one or more battery boxes providing power to the mobile marine service module.

3. The mobile marine service module of claim 1, wherein the plurality of buoyancy control chambers include a side float disposed on each side of the mobile marine service module.

4. The mobile marine service module of claim 3, wherein the plurality of buoyancy control chambers include one or more side tanks and one or more lower tanks.

5. The mobile marine service module of claim 1, further comprising hatch hydraulic actuators operable to independent operate the first and second side hatches and the middle hatch.

6. The mobile marine service module of claim 1, further comprising a working platform disposed along a bottom portion of the mobile marine service module.

7. A mobile marine service module comprising:

side floats disposed on each side of an enclosure, side tanks disposed on sides of the enclosure, and lower tanks disposed along a bottom of the enclosure, each of the side floats, side tanks and lower tanks operable to contain air and water to control the buoyancy of the mobile marine service module;

first and second side hatches formed into a leading edge of the mobile marine service module;

a middle hatch formed in the leading edge of the mobile marine service module, between the first and second side hatches;

hatch hydraulic actuators operable to independent operate the first and second side hatches and the middle hatch;

a hull seal disposed along the leading edge, the hull seal operable to seal against a hull of a vessel;

a control panel disposed in the mobile marine service module; and one or more battery boxes providing power to the mobile marine service module.

8. The mobile marine service module of claim 7, further comprising a working platform disposed along a bottom portion of the mobile marine service module.

9. A method for servicing a vessel while the vessel remains in water, the method comprising:

moving a mobile marine service module in place partially under the vessel, the mobile marine service module including a plurality of buoyancy control chambers operable to contain air and water to control the buoyancy of the mobile marine service module; first and second side hatches formed into a leading edge of the mobile marine service module; a middle hatch formed in the leading edge of the mobile marine service module, between the first and second side hatches; a hull seal disposed along the leading edge, the hull seal operable to seal against a hull of the vessel; and a control panel disposed in the mobile marine service module;

sealing the hull seal of the mobile marine service module along the hull of the vessel;

adjusting the buoyancy of the mobile marine service module such that an enclosure provided by the mobile marine service module extends out of the water;

removing water from the enclosure; and entering the enclosure to access a portion of the vessel while staying dry and while the vessel remains in the water.

10. The method of claim 9, further comprising opening one or more hatches while moving the mobile marine service module in place partially under the vessel.

* * * * *